United States Patent [19]

Kondo et al.

[11] 4,245,491

[45] Jan. 20, 1981

[54] METHOD AND DEVICE FOR PRODUCING HOLLOW ARTICLES HAVING FLANGES

[75] Inventors: Kazuyoshi Kondo, Okazaki; Yoshiaki Nakamura, Tsu, both of Japan

[73] Assignee: Kabushiki Kaisha Wako, Shizuoka, Japan

[21] Appl. No.: 843,886

[22] Filed: Oct. 20, 1977

[30] Foreign Application Priority Data

Oct. 21, 1976 [JP] Japan ..... 51-126553

[51] Int. Cl.[3] ..... B21C 23/00; B21D 31/00; B21D 53/26

[52] U.S. Cl. ..... 72/254; 72/264; 72/353; 72/354; 72/356; 72/359; 72/327; 72/325; 72/373; 72/377; 72/379

[58] Field of Search ..... 72/253-255, 72/264, 265, 351, 353, 354, 358, 359, 352, 356, 360, 325, 334, 266, 267, 326, 327, 331, 333, 338, 347-349, 377, 379, 374, 373, 376; 29/159.2; 113/121 C, 116 FF, 121 R

[56] References Cited

U.S. PATENT DOCUMENTS

| | | | |
|---|---|---|---|
| 942,989 | 12/1909 | Warren | 207/6.2 |
| 1,007,942 | 11/1911 | Hansen | 72/356 |
| 2,473,371 | 6/1949 | Heath et al. | 72/264 |
| 2,591,061 | 4/1952 | Gaudreau | 72/351 X |
| 3,050,849 | 8/1962 | Etchison et al. | 72/348 X |
| 3,307,737 | 3/1967 | Harvey et al. | 220/231 X |
| 3,387,481 | 6/1968 | Harvey et al. | 72/379 |
| 3,410,127 | 11/1968 | Burns | 72/256 |
| 3,477,608 | 11/1969 | Fraze | 113/121 R |
| 3,479,733 | 11/1969 | Brown | 113/121 C X |
| 3,528,275 | 9/1970 | Sibler | 72/265 |
| 3,610,015 | 10/1971 | Bollmann et al. | 72/264 |
| 3,750,606 | 8/1973 | Schultz | 113/121 C X |
| 3,771,480 | 11/1973 | Johnson | 72/360 |
| 3,812,803 | 5/1974 | Brown | 113/121 C |
| 3,977,225 | 8/1976 | Couchman | 72/265 |

FOREIGN PATENT DOCUMENTS

| | | | |
|---|---|---|---|
| 937283 | 1/1956 | Fed. Rep. of Germany | 72/264 |
| 1815019 | 2/1970 | Fed. Rep. of Germany | 113/121 C |
| 368312 | 2/1939 | Italy | 72/264 |
| 570954 | 7/1945 | United Kingdom | 72/264 |
| 407618 | 4/1974 | U.S.S.R. | 72/353 |

*Primary Examiner*—Lowell A. Larson

*Attorney, Agent, or Firm*—Fitzpatrick, Cella, Harper & Scinto

[57] ABSTRACT

A planar material to be press-formed is confined in a space having a contour corresponding to the outer contour of the flange part of an article to be produced and is pressed between a punch member having a through hole corresponding to the outer contour of the hollow main part of the article and another die member holding slidably a mandrel having an outer contour corresponding to the inner contour of the internal bore of the hollow article, the mandrel being simultaneously projected into the through hole of the first member. By the pressing action, the peripheral part of the material is formed into the flange part of the article while an inward flow of the material is caused, thereby elevating the surface of the material in the through hole of the punch member and forming a recess in the opposite side surface of the material. The mandrel is projected simultaneously with said pressing action, whereby topless hat-shaped product is easily formed by one step.

4 Claims, 10 Drawing Figures

FIG.2(III)
PRIOR ART
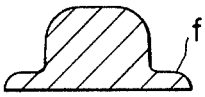

Fig. 3[I].
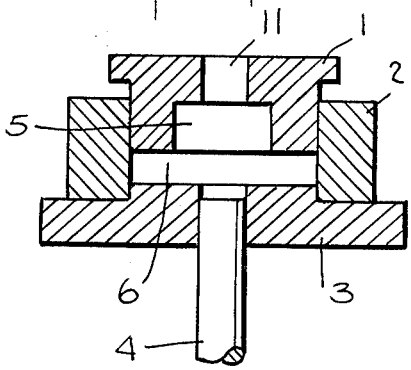
Fig. 3[II].
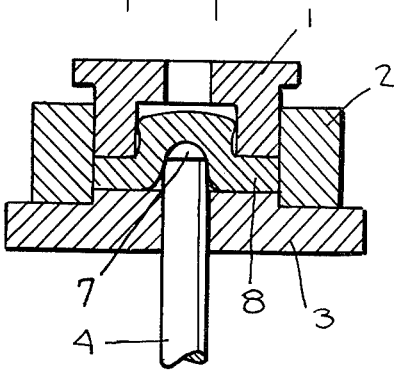
Fig. 3[III].
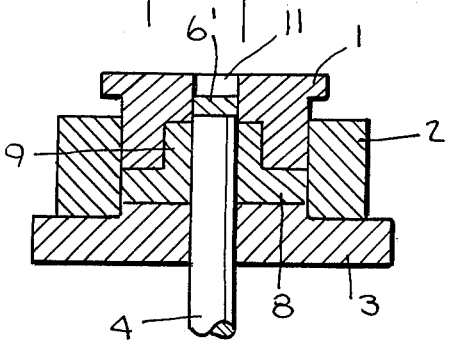
Fig. 4.
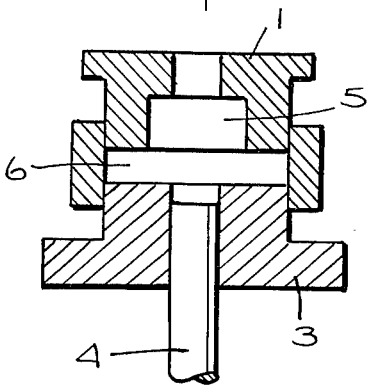
Fig. 5.
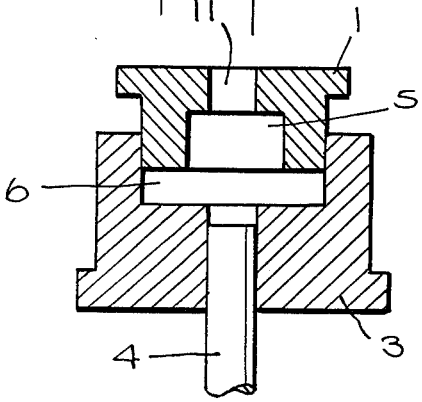

METHOD AND DEVICE FOR PRODUCING HOLLOW ARTICLES HAVING FLANGES

BACKGROUND OF THE INVENTION

This invention relates to a method and device for press-forming a topless hat-shaped hollow article having a flange as shown in FIG. 1 in one step by utilizing a method of forming a planar material by plastic deformation.

There are a great variety of hollow articles having flanges at their ends, such as hollow hat-shaped bodies such as gear blanks b as shown in FIG. 1. A convential method for producing these articles is shown in FIGS. 2(I)–2(IV).

The conventional method shown in FIG. 2 for producing a topless hat-shaped hollow article having a through hole internally comprises cropping a bar material into a blank d as shown in FIG. 2(I), smoothing both ends thereof and providing the blank with a tapered surfaces e as shown in FIG. 2(II), forming a hat-shaped blank by swaging a flange part f as shown in FIG. 2(III), and forming the outside of a hollow part g and the internal hole h therein as shown in FIG. 2(IV) by forcing a mandrel into the hole h and then piercing said mandrel through the top part of the product thereby to form the article (b) such as shown in FIG. 1. In this case, formation of the top hole of the product may be carried out together with the step for forming the hole h in FIG. 2(IV). This method requires not only four steps of operation, inclusive of one for material cropping into a blank, but also a great force in piercing the mandrel into the blank for press-forming the hollow part g. This force is applied through an area not wider than the cross-sectional area of the mandrel, thus entailing disadvantageous features such as buckling of the mandrel and shortening of the operational life of the same. Although there are methods for drilling and shaping the internal bore, these methods are not suitable for quantity or mass production and for reasons of economy.

SUMMARY OF THE INVENTION

A primary object of the invention is to provide a method and device for producing topless hat-shaped hollow articles with through holes and flanges, such as gears having boss parts, and their blanks, in one step out of a planar material by utilizing plastic deformation of the material.

According to the present invention, there is provided a method for producing a hollow article with a flange and through hole, comprising the steps of:

arranging in a mutually opposed relation a first tool member provided with a through hole having an inner contour corresponding to the outer contour of the hollow main part of the article and second tool member supporting a mandrel having an outer contour corresponding to the inner contour of the internal hole of the hollow article, so that a vertically compressable space for inserting therein a planar material and for providing an inner contour corresponding to the outer contour of the flange part of the article is formed therebetween;

the first tool member being further provided with a die hole at the end of the through hole remote from the second tool member to operate cooperatively with the mandrel;

inserting in the space a material of a planar shape and of a size equal to or slightly smaller than the inner contour of the space;

pressing the two tool members together so that the flange part of the article is press-formed out of the peripheral part of the material, the press-forming of the peripheral part causing a flow of material into the through hole of the first tool member thereby elevating the surface of the material in the through hole;

projecting simultaneously the mandrel into the space thereby forming the hollow main part of the article in hat shape out of the material; and further projecting the mandrel so that the top of the hat-shaped part is punched off between the mandrel and the die hole thereby forming a through hole in the article.

The nature, principle, and the utility of the present invention will be made apparent from the following detailed description of the invention when read in conjunction with the accompanying drawings.

BRIEF DESCRIPTION OF THE DRAWINGS

In the drawings:

FIGS. 3(I), 3(II) and 3(III) are longitudinal sectional views of a tool for practicing the present invention in the fabrication of a topless hollow article having a flange;

FIGS. 4 and 5 are longitudinal sectional views showing other versions of tools for practicing the present invention;

DETAILED DESCRIPTION

Figure 1:
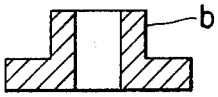
FIG. 1 is a longitudinal sectional view of a gear blank with a through hole which constitutes an example of hollow products according to the present invention.

A press-forming method constituting a basic process according to the present invention will be first described with reference to FIGS. 3(I), 3(II) and 3(III).

As shown in FIG. 3(I), a punch member 1 having a through hole 5 and a die hole 11 at the center, a clamping ring 2 fitting around the punch member 1, and a die member 3 are assembled together as shown with a piece of planar material 6 placed in a space defined by and between said three members while a mandrel having an outer diameter equal to the inner diameter of the hollow product being retracted from the top surface of the die member 3;

As shown in FIG. 3(II), upon depression of the punch member 1 toward the die member 3, the peripheral part of the material 6 is deformed and reduced in volume so as to form flange part 8 of the hollow product, whereby an inward flow of the material is caused, resulting in a rising up of the central part of the material into the through hole 5 of the punch member 1 and forming a recess 7 in the lower central part of the material. This phenomenon has been known as a "recess forming step" appearing at the final stage of a conventional extrusion process. Theoretically it is considered that the phenomenon occurs when the thickness of a part of the material coming under the punch member 1 is reduced to approximately 0.73 to 0.88 times the radius of the through hole 5.

When the thickness of the planar material in the aforementioned part is reduced to a value less than approximately 0.5 times the radius of the through hole 5, the formation of the recess 7 becomes significant, whereby the material is formed into a hat shape.

Simultaneously with the abovementioned depression of the punch member 1 through a hole at the center of the die member 3, the mandrel 4 is projected into the recess 7 and then pierced into the die hole 11 in a slidable manner as shown in FIG. 3(III), whereby top part 6' of the hat-shaped product is punched out by the mandrel 4 in cooperation with the die hole 11 and the thus formed topless hat-shaped product can be easily produced in one step.

As will be apparent from the above description, a characteristic feature of the present invention is the use of the planar material 6 and provision of the mandrel 4 capable of being projected into the material and pierced through the material while the punch member and die member having the die hole are pressed. The rate of the projection of the mandrel 4 relative to the rate of augmenting the pressing action between the punch member 1 and the die member 3 must be kept in a constant relation with the ratio of the cross-sectional area of the hollow product to the corss-sectional area of the flange part 7 thereof (i.e. the press-forming ratio). However, in practice, a required projection rate of the mandrel 4 can be automatically obtained in accordance with an increase in the pressing force between the punch member 1 and the die member 3.

In this case, by selecting the load of the mandrel 4 at a higher value than that required, and by positively driving the mandrel at the aforementioned rate, the force required for driving the punch member 1 can be substantially reduced. It should be noted, however, that when the load of the mandrel is elevated excessively, the tension in the hollow main part 9 of the product is elevated thereby reducing the thickness of the wall until a partial contraction is exhibited. Therefore, an upper limit always exists in the load applicable to the mandrel 4.

In a practical example of the present invention, a punch member 1 having a 24-mm outer diameter and a 15-mm inner diameter and a mandrel 4 of 10-mm outer diameter were used for press-forming a circular plate 6 made of pure aluminum of 4-mm thickness and 24-mm diameter into a hollow product having a flange until a wall thickness of 2 mm was obtained. In this operation, when the load applied to the mandrel 4 was selected at 0.4 metric ton, the squeezing load required for the punch member 1 was 12.5 tons. For every increase of 0.1 ton in the load applied to the mandrel 4, the squeezing load applied to the punch member 1 was reduced by one ton.

Figure 2I:
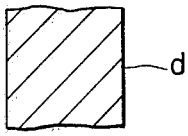
FIG.2(I) PRIOR ART
FIGS. 2(I), 2(II), 2(III), and 2(IV) are longitudinal sectional views illustrating conventional process steps in the fabrication of a hat-shaped body as shown in FIG. 1.
Figure 2:
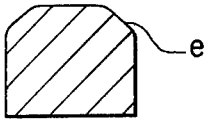
FIG.2(II) PRIOR ART
Figure 2:
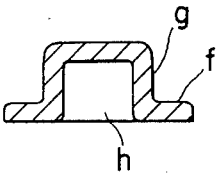
FIG.2(IV) PRIOR ART

According to the production method of this invention, not only the required force for the mandrel, but also the squeezing load applied to the punch member can be reduced to a comparatively small value. For the purpose of comparing the load for the mandrel in this example to that in the conventional method as shown in FIGS. 2(I), 2(II) and 2(III), a hole corresponding to that produced in this example was formed in the same pure aluminum plate under application of the same load on the mandrel, but without application of the squeezing load of the punch member. It was found that only approximately 20 percent of the depth of this example could be obtained. According to the present invention, there is no possibility of buckling or damaging the mandrel, and the operational life of the mandrel can be substantially elongated.

In the above example as mentioned in connection with FIGS. 3(I), 3(II) and 3(III), the inner diameter of the die hole 11 is selected to be slightly greater than that of internal bore of the product so that a punching clearance is maintained therebetween. The die hole 11 may otherwise be provided in a separate member integrally secured to the upper part of the punch member 1. in either of these cases, the upper end of the mandrel 4 is formed into a specific shape adapted for executing a punching operation.

Although a product having circular cross section has been indicated, it is apparent that a product of a polygonal contour or a spline-toothed contour can be obtained by the use of a punch member 1 and a mandrel 4 having outer and inner configurations corresponding to the contour of the product.

Furthermore, the clamping ring 2 of the example shown in FIGS. 3(I) to 3(III) may be unified with the punch member 1 or the die member 3, as shown in FIGS. 4 and 5.

According to the present invention, the phenomenon wherein when a material is confined outwardly and the peripheral part thereof is press-formed by a punch having an internal hole into a flange part of a article, the central part of the material is raised into the internal hole of the die by the material flow and a recess is formed in the opposite side surface of the material, is utilized. By forcing a mandrel into the recess, the internal hole of the product article is formed while positively aiding the formation of the recess, and the press formation of a hollow product with a flange can be accomplished in one step. Accordingly, the cost and the time required for the production can be substantially reduced. Furthermore, since the formation of the flange part and the hollow main part of the article are both performed by utilizing the same flow of the material, the force exerted on the die is assisted by the force exerted on the mandrel, thus affording a reduction of the two forces. This in turn reduces the load per unit area of the mandrel having a comparatively small diameter, and the operational life of the mandrel can be thereby substantially elongated. It will be apparent that the invention is applicable to the production of various machine parts and articles having a topless hat-shape.

We claim:

1. A method for producing a topless hat-shaped hollow article having a flange comprising the steps of:

arranging in a mutually opposed relation a first tool member provided with a through hole having an inner contour corresponding to the outer contour of the hollow main part of the hollow article and a second tool member carrying slidably a mandrel having an outer contour corresponding to the inner contour of the internal hole of the hollow article, thereby forming a vertically compressible space therebetween to provide an inner contour corresponding to the outer contour of the flange part of the article;

said first tool member being further provided with a die hole at the end of said through hole remote from the second tool member to operate cooperatively with the mandrel;

inserting in said space a material of a planar shape and of a size equal to or slightly smaller than the inner contour of said space;

pressing the two members together so that the flange part of the article is press-formed out of the peripheral part of the material, the press-forming of the peripheral part causing a flow of material into said through hole of the first tool member thereby elevating the surface of the material in said through hole and forming a recess in said elevated part;

simultaneously projecting the mandrel into said recess so as to form the hollow main part of the article in hat shape; and further projecting the mandrel so that the top of the hat-shaped part is punched between the mandrel and the die hole thereby forming a through hole in the article.

2. A device for producing from a planar blank material a topless hollow article having a flange comprising:

a hollow punch means provided with a top die hole having a diameter corresponding to the inner contour of the hollow part of the article to be formed and with a through hole having an inner contour corresponding to the outer contour of the hollow main part of said article to be formed;

die means disposed in confrontation with said punch means and formed with a through hole having a diameter corresponding to the inner contour of the hollow part of the article;

a mandrel slidably disposed in the through hole of said die means and having an outer contour corresponding to the inner contour of the hollow part of the article to be formed;

clamping means having an internal hole capable of receiving said punch means therein for slidable movement of said punch means toward or away from said die means; and said punch means, die means, and mandrel being arranged so that opposed surfaces of said punch means and said die means can be urged toward each other when a planar blank material is clamped between said surfaces to form the flange part of said article while causing formation of a recess at the central part of said blank material, and said mandrel being projectable into said recess part through said through hole of said die means while said punch means and die means are urged towards each other and further can be projected into the die hole of said punch means thereby to cut a top hole in the article.

3. A device for producing a topless hat-shaped article having a flange, as claimed in claim 2, in which the clamping means is replaced by a clamping wall part unified with the punch means.

4. A device for producing a topless hat-shaped article having a flange, as claimed in claim 2, in which the clamping means is replaced by a clamping wall part unified with the die means.

* * * * *